US006444380B1

(12) United States Patent
Patel et al.

(10) Patent No.: US 6,444,380 B1
(45) Date of Patent: Sep. 3, 2002

(54) FILMING PROCESS FOR ELECTROPHOTOGRAPHIC SCREEN (EPS) FORMATION

(75) Inventors: Himanshu Mukundray Patel, Escondido, CA (US); Jeffrey Herbert Harrell, Marion; Charles Henry Knepfler, Hamilton, both of IN (US)

(73) Assignee: Thomson Licensing S. A., Beulogne Cedex (FR)

( * ) Notice: Subject to any disclaimer, the term of this patent is extended or adjusted under 35 U.S.C. 154(b) by 39 days.

(21) Appl. No.: 09/760,952

(22) Filed: Jan. 16, 2001

(51) Int. Cl.[7] ..... H01J 9/20
(52) U.S. Cl. ..... 430/23; 427/68
(58) Field of Search ..... 430/23, 24, 25, 430/28; 427/68

(56) References Cited

U.S. PATENT DOCUMENTS

| | | | | |
|---|---|---|---|---|
| 3,558,310 A | 1/1971 | Mayaud | 96/36.1 |
| 5,370,952 A | 12/1994 | Datta et al. | 430/28 |
| 5,474,866 A | 12/1995 | Ritt et al. | 430/23 |
| 5,554,468 A | 9/1996 | Datta et al. | 430/28 |
| 5,807,435 A | 9/1998 | Poliniak et al. | 118/504 |
| 5,925,485 A | 7/1999 | Patel et al. | 430/29 |
| 6,013,400 A | 1/2000 | Laperuta et al. | 430/24 |
| 6,037,086 A | 3/2000 | Gorog et al. | 430/25 |

FOREIGN PATENT DOCUMENTS

EP 0 467 357 A * 1/1992

* cited by examiner

*Primary Examiner*—John A. McPherson
(74) *Attorney, Agent, or Firm*—Joseph S. Tripoli; Dennis H. Irlbeck; Carlos M. Herrera

(57) ABSTRACT

A method of manufacturing a luminescent screen assembly for a color cathode-ray tube (CRT) is disclosed. The luminescent screen assembly is formed on an interior surface of a faceplate panel of the CRT. The luminescent screen assembly includes color-emitting phosphors that are sequentially deposited over portions of the interior surface of the faceplate panel of the CRT. A filming composition is electrostatically sprayed over the color-emitting phosphors. The filming composition comprises an acrylic polymer dissolved in a solvent mixture of one or more high-volatility solvents combined with one or more low-volatility solvents.

12 Claims, 4 Drawing Sheets

FILMING PROCESS FOR ELECTROPHOTOGRAPHIC SCREEN (EPS) FORMATION

This invention relates to a color cathode-ray tube (CRT) and, more particularly to the manufacturing of a luminescent screen assembly using a filming composition comprising an acrylic polymer dissolved in a solvent mixture of one or more high-volatility solvents combined with one or more low-volatility solvents.

BACKGROUND OF THE INVENTION

A color cathode-ray tube (CRT) typically includes an electron gun, an aperture mask, and a screen. The aperture mask is interposed between the electron gun and the screen. The screen is located on an inner surface of a faceplate panel of the CRT tube. The aperture mask functions to direct electron beams generated in the electron gun toward appropriate color-emitting phosphors on the screen of the CRT tube.

The screen may be a luminescent screen. Luminescent screens typically comprise an array of three different color-emitting phosphors (e.g., green, blue, and red) formed thereon.

Luminescent screens may be formed using an electrophotographic screening (EPS) process. In EPS processes, an organic photoconductive (OPC) layer is sprayed over an organic conductive (OC) layer, formed on an interior surface of a CRT faceplate panel having a light-absorbing material formed on portions thereof. Color-emitting phosphors are sequentially deposited on portions of the OPC layer and fixed with an appropriate fixative to secure the phosphors to the OPC layer. Thereafter, the luminescent screen is further processed when a layer, or a film, of a material composition is applied over the fixed phosphors to provide a smooth surface.

The filming composition is applied over the fixed phosphors using an electrostatic spraying process within an enclosed electrostatic spray system. In an electrostatic spraying process, one or more electrostatic guns produce an aerosol of charged droplets of the filming composition, which is spray-deposited onto the fixed phosphor of the interior surface of the CRT faceplate panel to provide a smooth surface onto which an aluminum layer is deposited. One drawback with electrostatic spraying processes is that the aerosol of droplets may splatter on the components of the spray system forming film deposits on interior surfaces thereof. These film deposits provide a potential source of particles, which can potentially be deposited on the fixed phosphor surface during the filming process, resulting in undesirable screen blemishes.

Thus, a need exists for a suitable filming composition that overcomes the above-mentioned drawbacks.

SUMMARY OF THE INVENTION

The present invention relates to a method of manufacturing a luminescent screen assembly for a color cathode-ray tube (CRT). The luminescent screen assembly is formed on an interior surface of a faceplate panel of the CRT. The luminescent screen assembly includes an organic conductive (OC) layer overcoated with an organic photoconductive (OPC) layer. Different color-emitting phosphors are sequentially deposited over portions of the OPC layer and fixed with an appropriate fixative to secure the phosphors to the OPC layer.

Thereafter, the luminescent screen is completed when a filming composition is electrostatically sprayed over the fixed phosphors. The filming composition comprises an acrylic polymer dissolved in a solvent mixture of one or more high-volatility solvents combined with one or more low-volatility solvents.

BRIEF DESCRIPTION OF THE DRAWINGS

The invention will now be described in greater detail, with relation to the accompanying drawings, in which.

DETAILED DESCRIPTION OF THE PREFERRED EMBODIMENT

Figure 1:
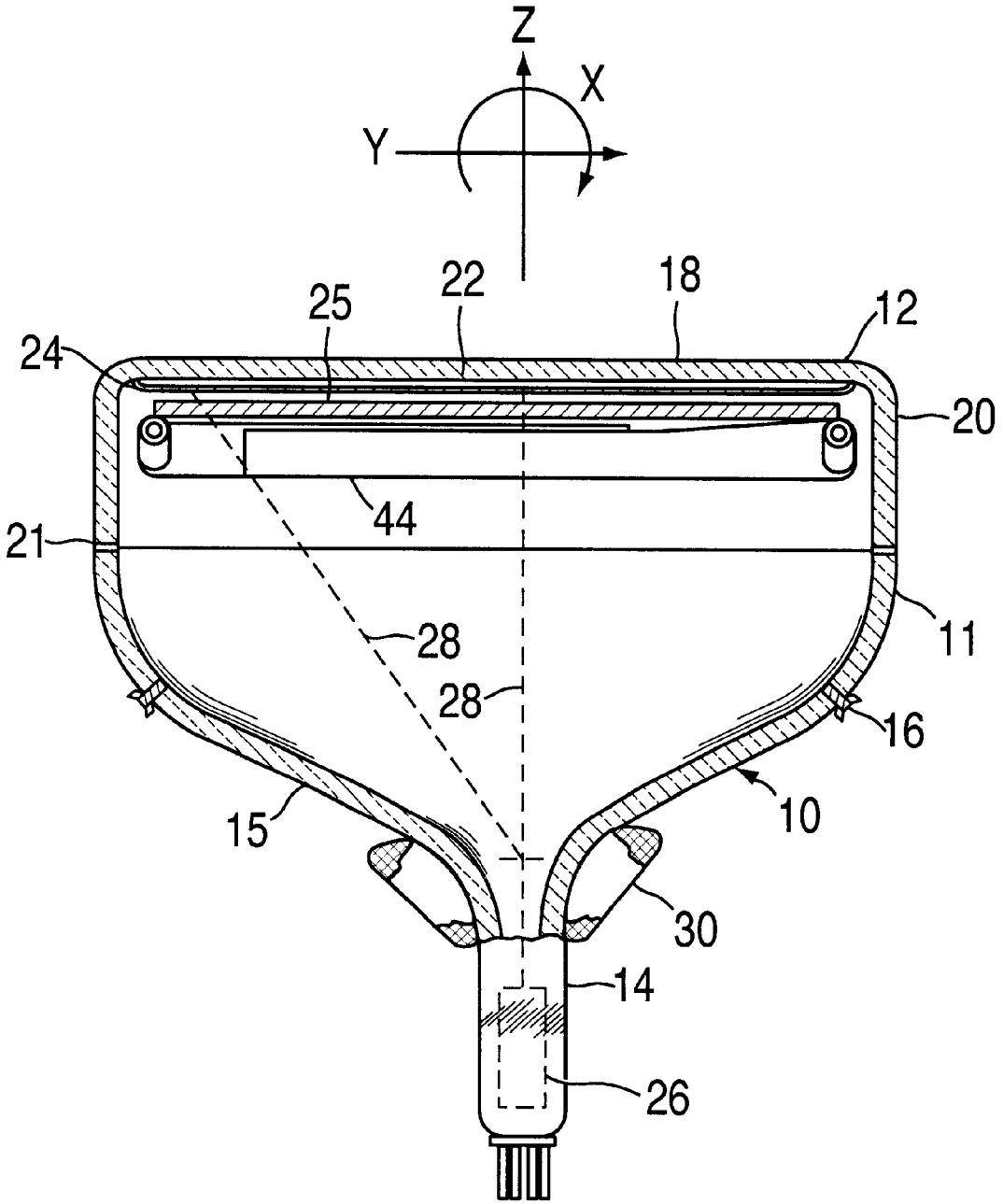
FIG. 1 is a plan view, partly in axial section, of a color cathode-ray tube (CRT) made according to the present invention.

FIG. 1 shows a conventional color cathode-ray tube (CRT) 10 having a glass envelope 11 comprising a faceplate panel 12 and a tubular neck 14 connected by a funnel 15. The funnel 15 has an internal conductive coating (not shown) that is in contact with, and extends from, an anode button 16 to the neck 14.

Figure 2:
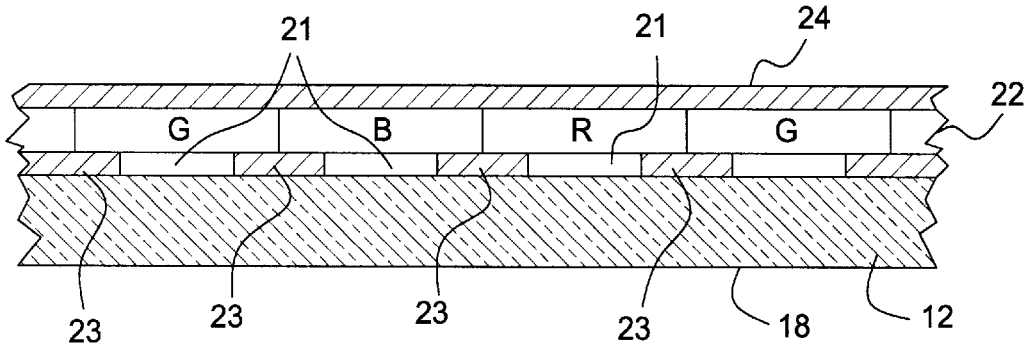
FIG. 2 is a section of a faceplate panel of the CRT of FIG. 1, showing a screen assembly.

The faceplate panel 12 comprises a viewing surface 18 and a peripheral flange or sidewall 20 that is sealed to the funnel 15 by a glass frit 21. A three-color luminescent phosphor screen 22 is carded on the inner surface of the faceplate panel 12. The screen 22, shown in cross-section in FIG. 2, is a line screen which includes a multiplicity of screen elements comprised of red-emitting, green-emitting, and bluee-mitting phosphor stripes R, G, and B, respectively, arranged in triads, each triad including a phosphor line of each of the three colors. The R, G, B, phosphor stripes extend in a direction that is generally normal to the plane in which the electron beams are generated.

A light-absorbing matrix 23, shown in FIG. 2, separates the phosphor lines. A thin conductive layer 24, preferably of aluminum, overlies the screen 22 and provides means for applying a uniform first anode potential to the screen 22, as well as for reflecting light, emitted from the phosphor elements, through the viewing surface 18. The screen 22 and the overlying aluminum layer 24 comprise a screen assembly.

A multi-aperture color selection electrode, or shadow mask 25 (shown in FIG. 1), is removably mounted, by conventional means, within the faceplate panel 12, in predetermined spaced relation to the screen 22.

An electron gun 26, shown schematically by the dashed lines in FIG. 1, is centrally mounted within the neck 14, to generate three inline electron beams 28, a center and two side or outer beams, along convergent paths through the shadow mask 25 to the screen 22. The inline direction of the beams 28 is approximately normal to the plane of the paper.

The CRT of FIG. 1, is designed to be used with an external magnetic deflection yoke, such as the yoke 30, shown in the neighborhood of the funnel-to-neck junction. When activated, the yoke 30 subjects the three electron beams 28 to magnetic fields that cause the beams to scan a horizontal and vertical rectangular raster across the screen 22.

Figure 3:
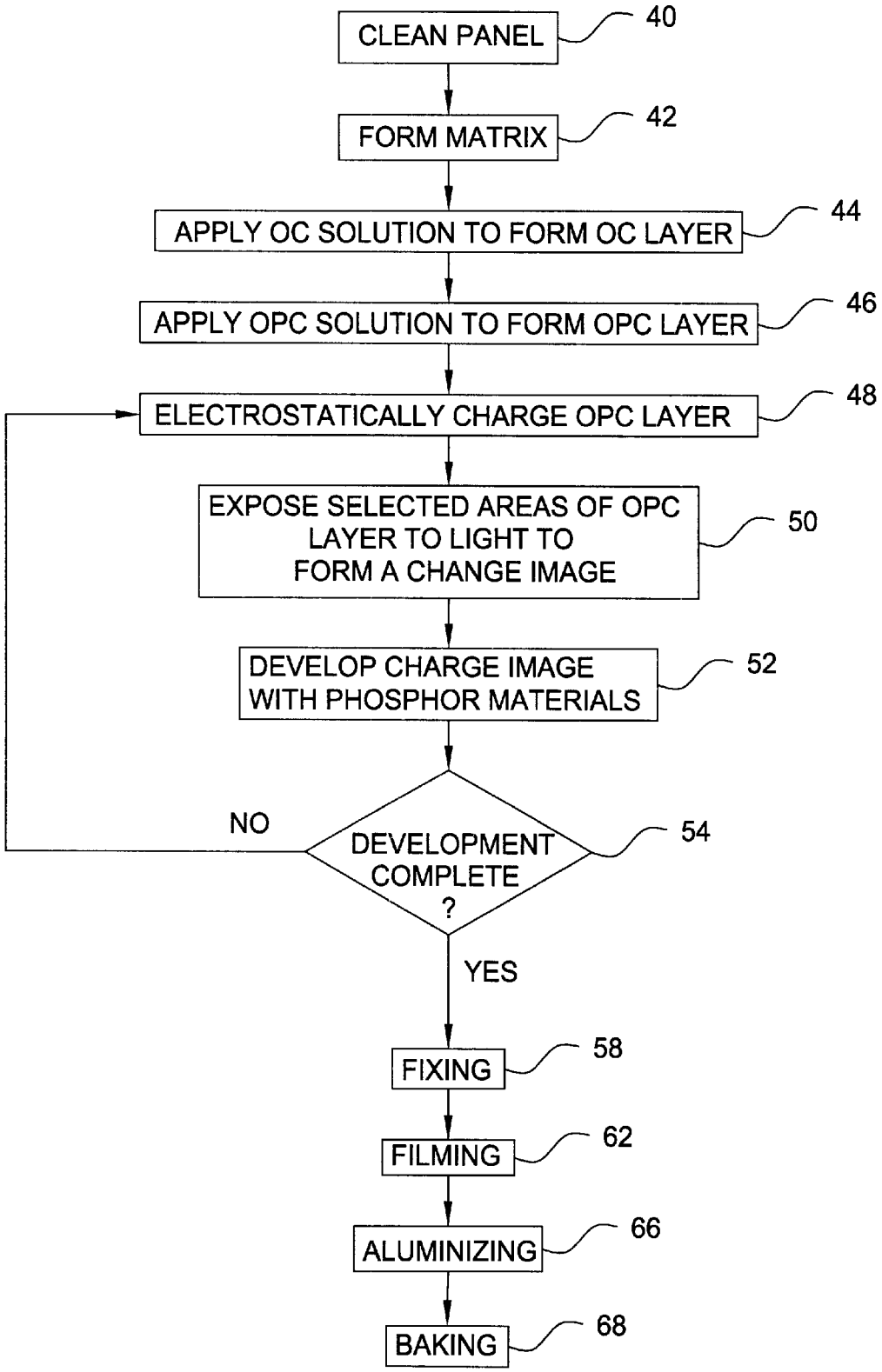
FIG. 3 is a block diagram comprising a flow chart of the manufacturing process for the screen assembly of FIG. 2.

The screen 22 is manufactured using an electrophotographic screening (EPS) process that is represented schematically in FIG. 3. Initially, the panel 12 is cleaned, as indicated by reference numeral 40, by washing it with a caustic solution, rinsing it in water, etching it with buffered hydrofluoric acid and rinsing it again with water, as is known in the art.

The interior surface of the faceplate panel 12 is then provided with a light absorbing matrix 23, as indicated by reference numeral 42, preferably, using a wet matrix process in a manner described in U.S. Pat. No. 3,558,310, issued Jan. 26, 1971 to Mayaud, U.S. Pat. No. 6,013,400 issued Jan. 11, 2000 to LaPeruta et al., or U.S. Pat. No. 6,037,086 issued Mar. 14, 2000 to Gorog et al.

The light-absorbing matrix is uniformly provided over the interior surface of the viewing faceplate panel 12. For a faceplate panel 12 having a diagonal dimension of about 68 cm (27 inches), the openings 21 formed in the layer of light-absorbing matrix 23 can have a width in a range of about 0.075 mm to about 0.25 mm, and the opaque matrix lines can have a width in a range of about 0.075 mm to about 0.30 mm.

Figure 4A:
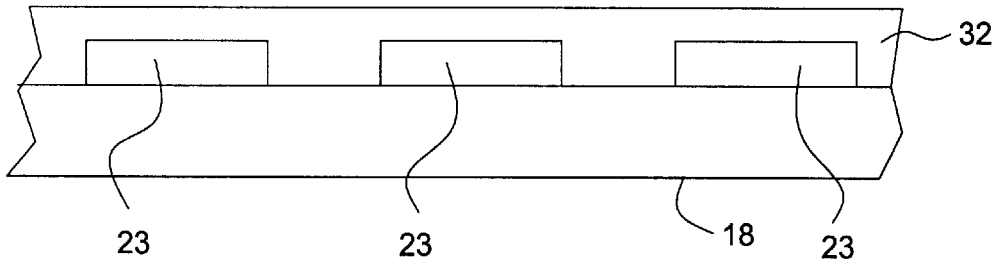
FIGS. 4*a*–4*b* depict views of the interior surface of the faceplate panel luminescent screen during photoreceptor formation.

Referring to FIG. 4*a*, the interior surface of the viewing surface 18, having the matrix 23 thereon, is then coated with a suitable layer of a volatilizable, organic conductive (OC) material 32. Suitable OC materials 32 and suitable methods for applying OC materials 32 such as those disclosed in U.S. Pat. No. 5,370,952 issued Dec. 6, 1994 to Datta et al. can be employed. OC materials 32 can include quaternary ammonium polyelectrolytes such as, for example, poly(dimethyldiallyl-ammonium chloride), poly(3,4-dimethylene-N-dimethyl-pyrrolidium chloride), poly(3,4-dimethylene-N-dimethyl-pyrrolidium phosphate)(3,4-DNDP nitrate), and poly(3,4-dimethylene-N-dimethyl-pyrrolidium phosphate)(3,4-DNDP phosphate). Alternatively, a copolymer of vinylimidazolium methosulfate (VIM) and vinylpyrrolidone (VP) may be used. The OC layer 32 typically has a thickness within a range of about 0.5 microns to about 2 microns.

Figure 4B:
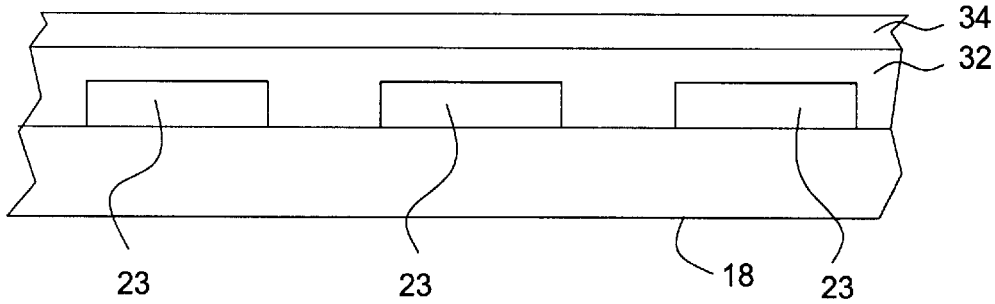

An organic photoconductive (OPC) layer 34 is formed over the layer of OC material 32, as shown in FIG. 4*b*. A suitable OPC layer 34 such as that described in U.S. Pat. No. 5,554,468 issued Sep. 10, 1996 to Datta et al. can be employed. An OPC layer 34 is formed by overcoating the layer of OC material 32 with an OPC solution containing polystyrene resin, an electron donor material, such as 1,4-di(2,4-methyl phenyl)-1,4 diphenylbutatriene (2,4-DMPBT); an electron acceptor materials, such as 2,4,7-trinitro-9-fluorenone (TNF) and 2-ethylanthroquinone (2-EAQ), and a suitable solvent, such as toluene, xylene, or a mixture of toluene and xylene. A surfactant, such as silicone U-7602; and a plasticizer, such as dioctyl phthalate (DOP), may also be added to the OPC solution. The surfactant U-7602 is commercially available from Union Carbide, Danbury, Conn.

Figure 5:
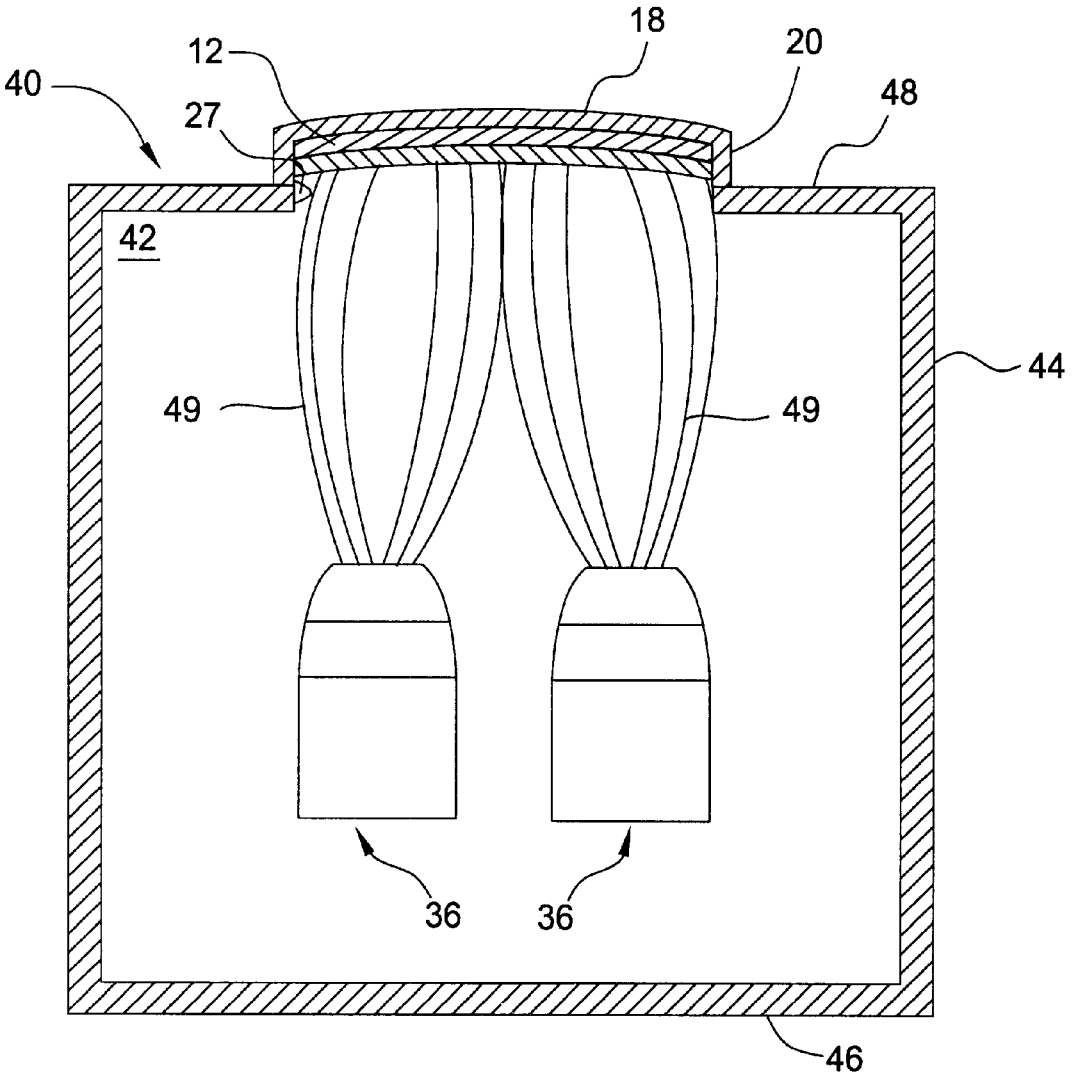
FIG. 5 is a flowchart illustrating the steps used in conjunction with the manufacturing process for the screen assembly of FIG. 2 consistent with the present invention.

The OPC solution may be applied over the layer of OC material 32 using an electrostatic spray module 40, shown in FIG. 5. A suitable method for applying the OPC layer 34 is disclosed in U.S. Pat. No. 5,807,435 issued Sep. 15, 1998 to Poliniak et al. The electrostatic spray module 40 includes an enclosure 42 having four sidewalls 44 and a base 46. The faceplate panel 12 is mounted on the top 48 of the enclosure 42 over an opening therein, such that the interior surface of the faceplate panel 12 covers the opening. One or more electrostatic spray guns 36 are disposed within the enclosure 42 at a fixed distance from the top 48 of the enclosure. Suitable electrostatic spray guns 36 include AEROBELL™ electrostatic spray guns commercially available from ITW Ransburg, Toledo, Ohio.

Two electrostatic spray guns 36 are preferred for spraying the OPC solution onto a 68 cm panel within an application time of 60 seconds or less, and three such guns also are preferred for panels having dimensions within a range of 89 to 91 cm. The electrostatic spray guns 36 provide an aerosol of negatively charged droplets 49 of the OPC solution on the layer of OC material 32. The layer of OC material 32 is grounded by means of a metal stud 27, which is affixed to the sidewall 20 of the faceplate panel 12 during the electrostatic spraying operation to attract the negatively charged droplets of the OPC solution toward the interior of the faceplate panel 12.

The following steps are directed to printing of the color-emitting phosphor material. After the OPC layer 34 is applied, it is uniformly electrostatically charged, as indicated by reference numeral 48 (in FIG. 3), using a corona discharge device (not shown). The OPC layer 34 is typically charged to a voltage within a range of about +200 volts to about +700 volts.

Thereafter, the shadow mask 25 is reinserted into the faceplate panel 12, placed in a lighthouse (not shown), and exposed, through the shadow mask 25, with light from a suitable light source disposed within the lighthouse. The light passes through the apertures in the shadow mask 25, at an angle identical to that of the electron beams 28 from the electron gun 26 of the tube 10, discharging the illuminated areas on the OPC layer 34 so as to form a charge image, as indicated by reference numeral 50 (in FIG. 3).

The shadow mask 25 is removed from the faceplate panel 12, and the panel is placed onto a first phosphor developer containing, first color-emitting phosphor material, to develop the charge image, as indicated by reference numeral 52. The first color-emitting phosphor material is positively triboelectrical charged within the developer and directed toward the OPC layer 34. The positively charged first colore-mitting phosphor material is repelled by the positively charged areas on the OPC layer 34 and deposited onto the discharged areas thereof by the process known in the art as "reversal" development. In reversal development, triboelectrically charged particles of phosphor material are repelled by similarly charged areas of the OPC layer 34 and deposited onto the discharged areas thereof.

The size of each of the lines of the first color-emitting phosphor elements is slightly larger than the size of the openings 21 of the matrix 23, to provide complete coverage of each opening 21, and a slight overlap on the matrix 23 surrounding the openings 21. Because a total of three different color-emitting phosphors are required to form the screen 22, the light exposure step 50 and the phosphor development step 52 are repeated for each of the other two color-emitting phosphors. The application of color-emitting phosphor material is more clearly described in U.S. Pat. No. 5,474,866 issued Dec. 12, 1995 to Ritt et al., which is incorporated herein by reference.

The subsequent method to fix the color-emitting phosphor material into the OPC layer 34 consistent with the present invention, is the method disclosed in U.S. Pat. No. 5,925,485 issued Jul. 20, 1999 to Patel et al. or any other suitable method. This method generally includes fixing the three light-emitting phosphors with a suitable fixative composition, as indicated by step 58 in FIG. 3. Suitable fixative compositions comprise mixtures of solvents such as methyl isobutyl ketone (MIBK) and d-limonene. The fixative mixture preferably combines the MIBK and d-limonene in a ratio of about 2:1.

The fixative composition is applied to the phosphors using the electrostatic spray system, described in U.S. Pat. No. 5,807,435 issued Sep. 15, 1998 to Poliniak et al. The electrostatic spray system provides negatively charged droplets which wet the phosphors and the underlying OPC layer 34, without moving the phosphors.

After the phosphors are fixed, they are filmed, as indicated by step 62 in FIG. 3, to provide a smooth surface over the screen 22 onto which an evaporated aluminum layer can be deposited. The filming composition, preferably, is deposited by electrostatically spraying a polymeric solution over the fixed phosphor screen elements.

The filming composition comprises about 3% by weight to about 10% by weight of an acrylic polymer dissolved in a solvent mixture including one or more high-volatility solvents combined with one or more low-volatility solvents. The amount of low-volatility solvents in the solvent mixture should preferably be within a range of about 1% by weight to about 7% by weight.

The combination of the high-volatility solvents with the low-volatility solvents advantageously reduces the evaporation rate of the filming composition. Reducing the evaporation rate of the filming composition reduces buildup on interior surfaces of electrostatic spray system during the filming process, minimizing the formation of screen blemishes. The low-volatility solvents should preferably have evaporation rates about 1.5 times lower than the evaporation rates of the one or more high-volatility solvents. Suitable acrylic polymers include polybutylmethacrylate and polymethylmethacrylate, among others.

The one or more high volatility solvents should preferably have a boiling point over 100° C. with a vapor pressure within a range of about 14 mm Hg to about 16 mm Hg, as well as a surface tension of about 20 dynes/cm$^2$ to about 30 dynes/cm$^2$. Suitable high-volatility solvents may include, for example, methyl isobutyl ketone (MIBK), xylene, and toluene, among others.

The one or more low-volatility solvents should preferably have a boiling point over 100° C. with a vapor pressure less than about 10 mm Hg, as well as a surface tension less than about 30 dynes/cm$^2$. Suitable low-volatility solvents may include high molecular weight alcohols such as, for example, butyl alcohol and octyl alcohol, among others.

The filming composition is preferably deposited on the fixed phosphors using an electrostatic spray module, as depicted in FIG. 5. After completing the fixing and filming operations, the screen 22 is aluminized, as known in the art, and then baked to a temperature of above 425° C. so that the volatilizable constituents are driven from the screen assembly (e. g., the OC layer, the OPC layer, and the filming layer).

What is claimed is:

1. A method of manufacturing a luminescent screen assembly on a faceplate panel of a color cathode-ray tube (CRT) wherein the faceplate panel has color emitting phosphors thereon, comprising: applying a filming composition over the color-emitting phosphors, wherein the filming composition comprises an acrylic polymer dissolved in a solvent mixture including one or more high-volatility solvents combined with one or more low-volatility solvents.

2. The method of claim 1 wherein the one or more low-volatility solvents have boiling points above about 100° C. with a vapor pressure less than about 10 mm Hg.

3. The method of claim 1 wherein the one or more low-volatility solvents have surface tensions less than about 30 dynes/cm$^2$.

4. The method of claim 1 wherein the filming composition comprises about 1% by weight to about 7% by weight of the one or more low-volatility solvents.

5. The method of claim 1 wherein the one or more low-volatility solvents are high molecular weight alcohols.

6. The method of claim 5 wherein the high molecular weight alcohols are selected from the group consisting of butyl alcohol, octyl alcohol, and combinations thereof.

7. The method of claim 1 wherein the one or more high-volatility solvents are selected from the group consisting of toluene, methyl isobutyl ketone (MIBK), xylene, and combinations thereof.

8. The method of claim 1 wherein the one or more high-volatility solvents have boiling points above about 100° C. with a vapor pressure in a range of about 14 mm Hg to about 16 mm Hg.

9. The method of claim 1 wherein the one or more high-volatility solvents have surface tensions in a range of about 20 dynes/cm$^2$ to about 30 dynes/cm$^2$.

10. The method of claim 1 wherein the one or more low-volatility solvents have evaporation rates about 1.5 times lower than the evaporation rates of the one or more high-volatility solvents.

11. The method of claim 1 wherein the acrylic polymer is selected from the group consisting of polybutylmethacrylate, polymethylmethacrylate, and combinations thereof.

12. The method of claim 1 wherein the filming composition comprises about 3% by weight to about 10% by weight of the acrylic polymer.

* * * * *